US006308437B1

(12) United States Patent
Villar

(10) Patent No.: US 6,308,437 B1
(45) Date of Patent: Oct. 30, 2001

(54) HUMIDOR WITH ENVIRONMENTAL CONTROL UNIT

(76) Inventor: Juan C. Villar, 36 Martin La., Westbury, NY (US) 11590

( * ) Notice: Subject to any disclaimer, the term of this patent is extended or adjusted under 35 U.S.C. 154(b) by 0 days.

(21) Appl. No.: 08/995,127

(22) Filed: Dec. 19, 1997

Related U.S. Application Data

(60) Provisional application No. 60/033,641, filed on Dec. 20, 1996.

(51) Int. Cl.[7] ..... F26B 21/06

(52) U.S. Cl. ..... 34/535; 34/542; 34/210; 34/219

(58) Field of Search ..... 34/380, 381, 389, 34/417, 535, 537, 542, 202, 210, 218, 219; 201/128, 130, 131, 142; 312/31.1; 131/250, 300, 328, 329; D27/183, 189, 190

(56) References Cited

U.S. PATENT DOCUMENTS

| | | | |
|---|---|---|---|
| D. 293,608 | 1/1988 | Fitzgerald | D27/45 |
| D. 380,582 | 7/1997 | Filias | D27/183 |
| D. 385,653 | 10/1997 | Wicker | D27/187 |
| D. 386,812 | 11/1997 | Schmidt | D27/187 |
| D. 389,601 | 1/1998 | Bartolotta | D27/188 |
| D. 389,952 | 1/1998 | Bartolotta | D27/188 |
| D. 391,670 | 3/1998 | Hargrove | D27/189 |
| D. 393,101 | 3/1998 | Kasuli | D27/187 |
| 4,008,930 | 2/1977 | Swainson | 312/31.1 |
| 4,428,892 * | 1/1984 | Berliner | 261/99 |
| 5,607,051 | 3/1997 | Espinosa | 206/213.1 |
| 5,651,262 | 7/1997 | Pendergast | 62/176.4 |
| 5,687,749 | 11/1997 | Brauer, Jr. | 131/329 |
| 5,741,444 | 4/1998 | Kasuli | 261/128 |
| 5,829,451 * | 11/1998 | Barber | 131/250 |

OTHER PUBLICATIONS

Heartland America catalog, p. 15, Item No. P3–4403, Apr. 1999.*

* cited by examiner

*Primary Examiner*—Henry Bennett
*Assistant Examiner*—Steve Gravini
(74) *Attorney, Agent, or Firm*—Cantor Colburn, LLP

(57) ABSTRACT

Disclosed is a humidor having means for controlling the humidity therein and having one or more transparent surfaces permitting viewing of the interior thereof. The humidor has means for lateral access to the contents therein and the depth of said container is substantially smaller than said width, thereby conserving space. Means are provided for displaying products, such as cigars, in a substantially vertical position for viewing through the transparent surfaces. In a preferred embodiment, the container is adapted to placement upon a shelf. In a preferred embodiment, an integrated environmental control unit that controls both temperature and humidity is described.

18 Claims, 4 Drawing Sheets

HUMIDOR WITH ENVIRONMENTAL CONTROL UNIT

PRIOR HISTORY

This application claims the benefit under 35 U.S.C. §119 (e) of U.S. provisional application Ser. No. 60/033,641 filed Dec. 20, 1996.

BACKGROUND OF THE INVENTION

1. Field of the Invention

This invention relates to humidors for maintaining moisture in vegetable matter in general and tobacco products in particular.

2. Description of the Related Art

Humidors have long been known for the storage of cigars and other vegetable matter. It is also known to provide large cabinet humidors having transparent surfaces in tobacco shops, that patrons might view the contents thereof and make purchase decisions.

A disadvantage of the prior art is that the contents of the cabinet humidors are difficult to view. Often the would-be purchaser must approach the humidor closely to peer through the transparent surfaces. Frequently, it is necessary to open the humidor to visually examine the cigars, despite the presence of transparent surfaces, because prior art humidors position the cigars in a generally horizontal position.

Prior art cabinet humidors are also often very large, indeed massive, and take up valuable floor space. Small tobacco shops will therefore usually not carry properly stored cigars. In restaurants, any humidor larger than the traditional box humidor takes up enough space that it must be mounted in the areas of the establishment that are accessible to patrons, since they will not fit behind the counter or bar. This creates a security problem often requiring the placement of a lock on the humidor door. Such locks waste valuable employee time since it is necessary for the would-be purchaser to track down an employee with the key. If an employee is not immediately available, a sale may be lost as the customer becomes frustrated.

Small box-type humidors are an unimpressive substitute for the larger cabinets. These boxes are best for home use, yet many business establishments, particularly nightclubs, use them because they are easily kept behind a bar or counter so as to eliminate the security problems. Unfortunately, valuable employee time is wasted when the customer must ask to see the available selection. The bartender or waiter must then stand patiently, box in hand, while the customer peers therein, asking the price of each brand and size of cigar.

Glass jar humidors are also known. These comprise glass jars in which cigars are tightly bundled. The cigars must be removed vertically by reaching down through the top of the jar. This type of humidor is useful for displaying only one type or brand of cigar and placement and removal of the contents is cumbersome and ungainly, particularly when the jar is full and the contents tightly packed. Similar jar-type humidors are described in U.S. Pat. No. 4,008,930 and in design patent U.S. Pat. No. D293,608.

A major disadvantage of both box-type and jar-type humidors is that they provide access to the products they contain from an opening at the top. Since humid air rises relative to dry air, each time a top-access-type humidor is opened the humid air therein is dumped into the atmosphere and rapidly replaced with drier air. Frequent cycles of humid and dry air can and will damage such products as fine hand-rolled cigars, causing their wrappers to flake and internal structure—the filler and binder—to fracture. This is because tobacco shrinks and expands in response to changing humidity. A typical nightclub might sell about sixty cigars in a single evening, representing sixty cycles of humidity shock to cigars stored in such containers.

This invention provides a humidor of space-saving resign that is easily adapted to a barshelf or mounted on a wall and may be used in small tobacco shops, bars, restaurants, nightclubs and other such establishments. The humidor of this invention allows easy viewing of the contents thereof, so that would-be purchasers can make a purchase decision without opening the humidor or consuming the valuable time of employees. Further, because of the space-saving features of the invention, the humidor may be placed or mounted behind a sales counter or other such employee/patron barrier and thereby provide effective security against theft and shoplifting. Alternatively, the humidor of the present invention may be mounted upon a wall while presenting a slim profile that will not waste valuable floor space. The humidor of this invention also provides lateral access to the contents thereof, allowing for ease of insertion and removal of the products stored and significantly reducing changes in humidity when opening and closing the container.

The unit provides a dramatic and prominent display of the goods therein, clearly displayed and illuminated. Though primarily intended for cigars, the unit is useful for certain valuable foodstuffs and is also of interest to certain specialty and health food stores.

BRIEF SUMMARY OF THE INVENTION

This invention relates to a humidor comprising a container having one or more transparent surfaces permitting viewing of the interior thereof, means for controlling the humidity within the container, and means for positioning a plurality of cigars in said container in a substantially vertical manner and position so as to permit effective viewing through said one or more transparent surfaces.

In the preferred embodiment, the humidor is sized and shaped for placement upon a barshelf or adapted for mounting on a restaurant wall or other business establishment, thereby permitting display of the cigars therein to patrons. In a still more preferred embodiment, means are provided to display the type and price of each variety of cigar displayed in the humidor. Patrons may then make a selection as to the type and brand of cigar to purchase without the aid of an employee of the establishment.

Also described is an easily manufactured environmental control unit that may be used with any humidor, including that of the present invention. Using components already commercially available, the space-saving device efficiently controls both temperature and humidity.

DETAILED DESCRIPTION OF THE INVENTION

This invention relates to a humidor comprising a container having one or more transparent surfaces permitting viewing of the interior thereof, means for controlling the humidity within the container, and means for positioning a plurality of cigars in said container in a substantially vertical manner and position so as to permit effective viewing through said one or more transparent surfaces.

Figure 1:
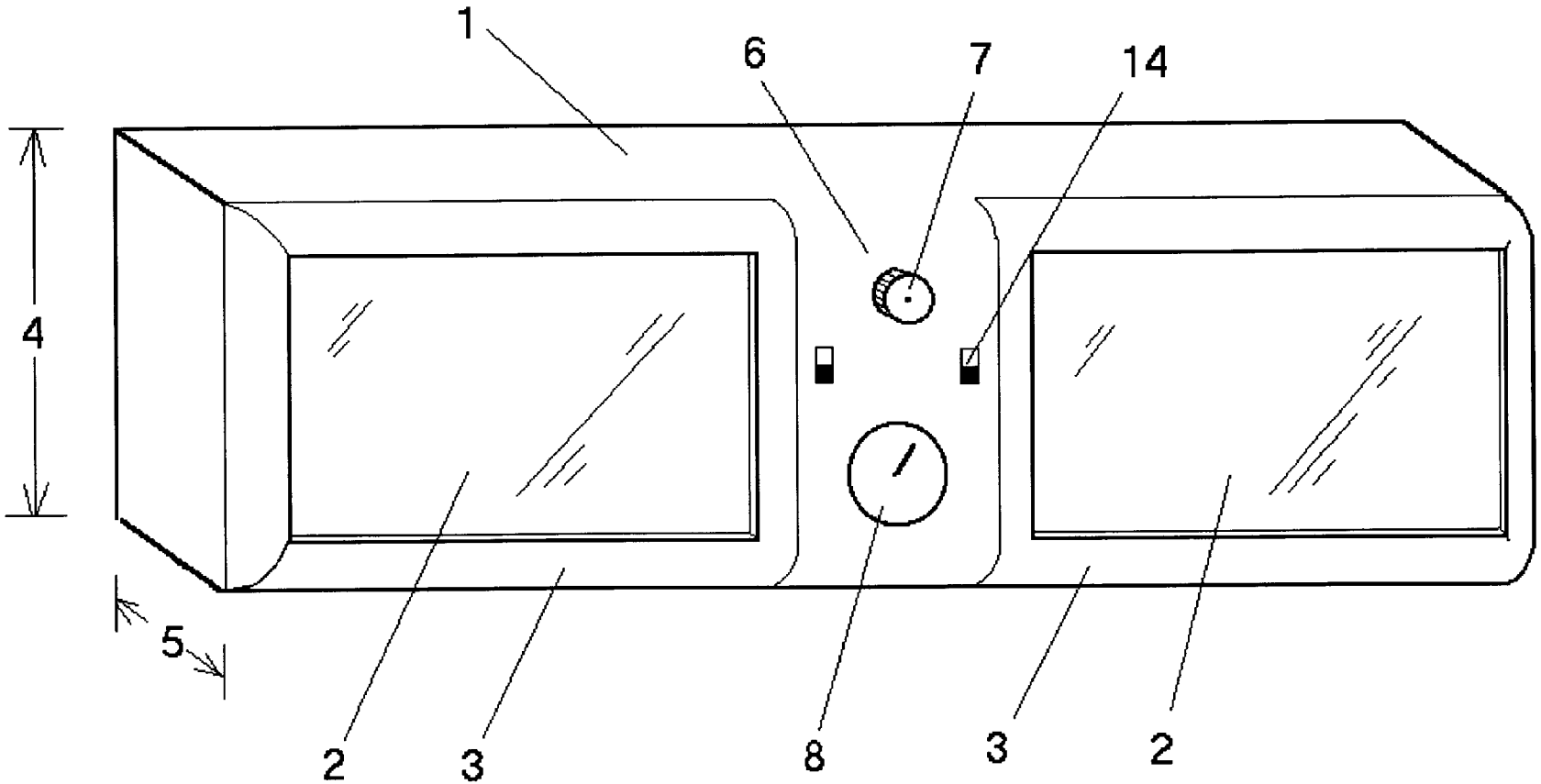
FIG. 1 is a perspective view of a preferred embodiment of the invention.

Referring to FIG. 1 there is depicted the "barshelf" embodiment of the present invention wherein there is provided a container 1 having a vertical dimension 4 generally not exceeding sixteen inches, preferably not exceeding fifteen inches, and more preferably not exceeding fourteen inches (i.e., about the height of the average liquor bottle) and a depth 5 generally not exceeding sixteen inches, preferably not exceeding 12 inches, and more preferably not exceeding 9 inches (i.e., not much deeper than a barshelf). This embodiment is primarily designed for the bar or nightclub proprietor who may easily and instantly convert his establishment into a "cigar-friendly" point of sale by simply clearing some bottles from a barshelf and mounting the unit in the space created thereby. Alternatively, the unit may also be used in stores containing shelving for other products. The width is at the discretion of the user and may be as wide as the intended use demands, but will be significantly larger than the depth. The space saving features of this invention are effected in the depth being substantially smaller than the width and less than or equal to the height. For a depth of ten inches, typical widths would be about thirty or more inches, generally about sixty to seventy inches, and in larger models about eighty to ninety inches. In general, the width will be at least twice the depth, typically at least thrice the depth, and preferably at least four times the depth. The height of the barshelf embodiment of FIG. 1 will generally be no more than about 1.5 times the depth, give or take an inch or two, as the situation demands.

In the embodiment shown, there is a central panel section 6, behind which is mounted means for controlling the humidity within the container, namely a humidifier (not shown) and, optionally, a dehumidification unit. For the purposes of this disclosure, "means for controlling humidity" will refer to any humidity control device, whether it humidifies, dehumidifies, or both. A temperature control unit may also be concealed behind this section. One or more panel controls 7 may be provided to set humidity and temperature. Light switches 14 may be provided here to control lights mounted within the humidor. One or more panel instruments 8 may also be provided to indicate humidity and temperature levels within the container. The panel section 6 need not be located in the center as shown. The actual location of the panel section is more a matter of esthetics than of function for smaller humidors, but if the container is constructed large relative to the power of the humidifier, then a generally central position will be preferred.

Preferred humidifiers are those of relatively small dimension and are electrically powered. Such units usually operate by simply blowing air upon a reservoir of water. Powered humidifiers are preferred over passive chemical-salt and evaporative-type humidifiers because it is anticipated that the hatches will be opened and closed frequently in commercial use, thereby requiring rapid means to maintain and restore the proper humidity levels for the products contained therein. For cigars, it is preferred that the relative humidity inside the container be kept at between 65 and 75 percent at about room temperature. As of the writing of this specification, suitable humidifiers include that sold under the tradename "Moist 'N Aire," manufactured and distributed by Globe Metal Manufacturing Company, 2150 North $10^{th}$ Street, Philadelphia, Pa. 19122 and another sold as the "Model 500U," manufactured and distributed by Herrmidifier Company, 1812 Colonial Village Lane, Lancaster, Pa. 17605. Both are powerful and compact, the latter being perhaps much more powerful than needed. Both have humidistats—devices that shut off the humidifiers when the desired humidity is reached. In order to make the controls available on the central panel section 6, it is necessary to perform some minor reassembly of the humidifiers, but this does not involve anything excessively complicated to anyone handy with a screwdriver and a soldering iron. These humidifiers are about nine and twelve inches in width, respectively, and permit the width of the panel section 6 to be kept down to about ten to thirteen inches in width.

Figure 4:
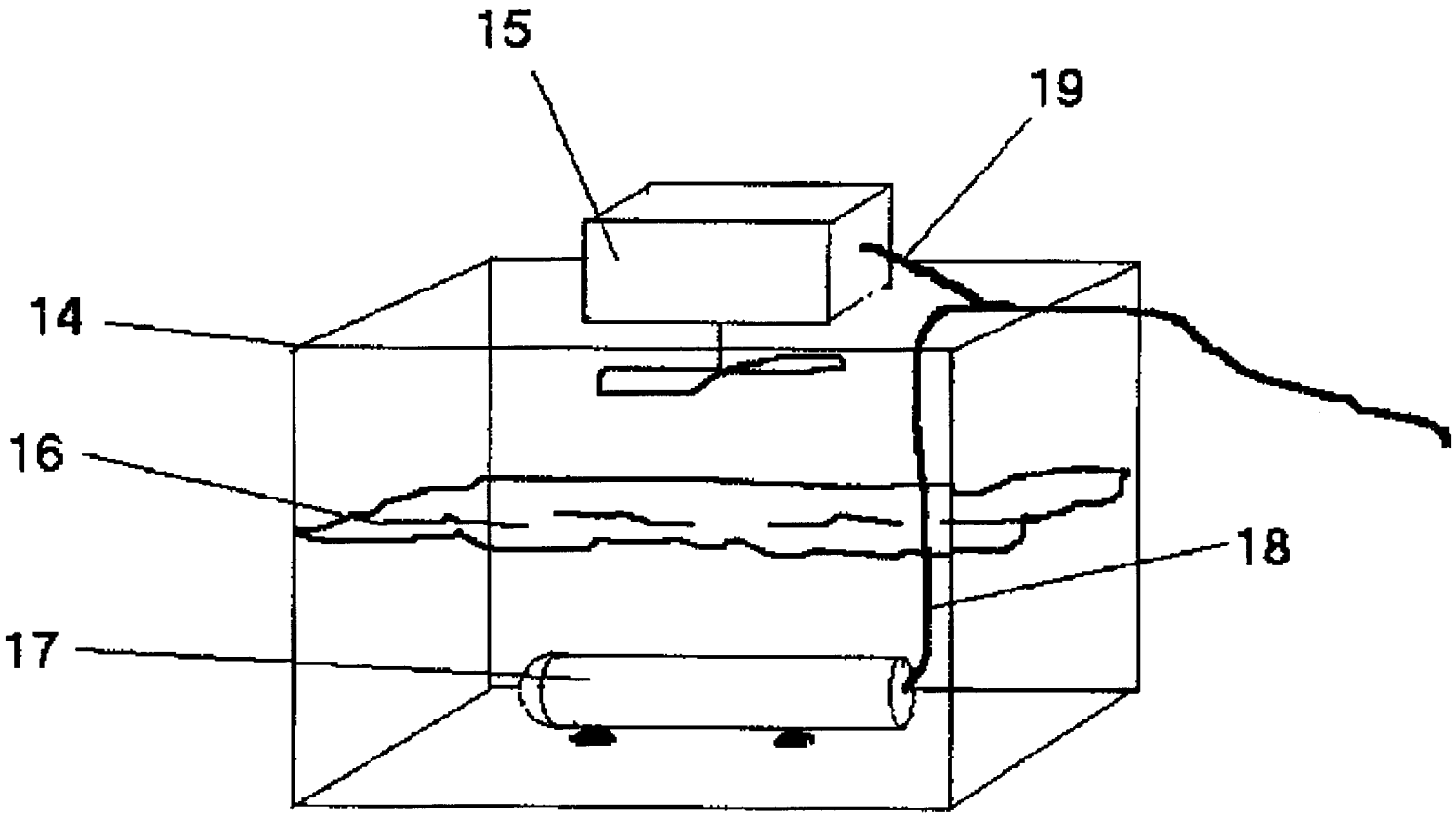
FIG. 4 is a transparent view of the environmental control unit of the invention.

As for temperature control, this is easily achieved by using commercially available fish tank heaters or other submersible heater. As shown in FIG. 4, a typical humidifier is shown comprising a reservoir 14 and means 15 for forcing air on a body of water therein. Below the water level 16 is submerged a typical fish tank heater 17, and the power cord 18 brought up out of the water and out. The combination results in a compact and highly effective integrated environmental control unit. In a preferred embodiment, this power cord is spliced into the power cord of the air blower 19 so as to enable the entire unit to be supplied through one power line. In some cases, the design of the submersible heater allows a temperature control to be rigged and made available on the central panel section 6. By using submersible heaters, the water reservoir of the humidifier may be made to double as a thermal reservoir having a strong thermal "momentum" that is highly effective is stabilizing the internal temperature. Further, the cooling effect of blowing air on the water reservoir is immediately detected and counteracted by the heater before the effects can be felt in throughout the humidor. For cigars and other tobacco products, it is preferred that the internal temperature be maintained between 60° and 80° Fahrenheit, preferably between 65° and 75° Fahrenheit. Ideally the interior of the container will be maintained at 70 percent relative humidity and 70° Fahrenheit when storing cigars—this is often referred to as the "70/70 Rule." Other means known in the art for controlling air temperature, such as air heating coils, may also be utilized.

Referring again to FIG. 1, there are also provided means for lateral access to the contents of the container in the form of one or more hatches 3 that cover lateral openings in the container. The hatches are preferably hinged to the container that they may be swung open. Also provided are one or more transparent surfaces 2 for permitting viewing of the contents of the container. These are preferably of glass or plastic or other material that prohibits the passage of water vapor. In the preferred embodiment, the transparent surfaces are mounted on the hatches as shown. Display cards 13 are positioned by display support means 12 so as to be visible through the transparent surfaces and permit display of product name, price, or other relevant information. The hatches are opened so as to permit access to the contents of the container. The hatches need not provide a hermetic seal when closed, but the fit should at least be close enough to prevent or significantly obstruct vapor leakage. Generally, the seal will be "loose" enough so as to disallow any more than a ten percent pressure differential between the interior of the container and the surrounding atmosphere, more preferably a five percent differential in pressure.

The hatch, therefore, will generally fit to the container with smoothly polished surfaces and will not be fitted with elastic seals. Where the doors are large and/or heavy, it is preferred that they be rabbeted to the container frame.

In the event elastic seals or O-rings are utilized, for example, to absorb shock where the hatches are very heavy and/or frequently slammed shut), it is preferred that one or more vents be cut through the container so as to allow the circulation of fresh air. Air circulation is preferred to prevent mildew and rot. Since humid air rises relative to dry air, it is preferred that such vents be cut or drilled up through the bottom of the container or in the sides of the container near or at the bottom surface. Of course, a bottom surface will only be accessible when the unit is wall-mounted as opposed to mounted on a shelf. Where fresh air is critical, it may be desirable to provide such vents whether the hatches are hermetically sealed or not. To ensure uniformity of humidity, it is advisable to provide such vents at or near the humidifier so that the unit may humidify the fresh air before it comes in contact with the contents of the humidor. The curved surfaces depicted on the hatches in the figures are for esthetic purposes and are purely optional.

Figure 2:
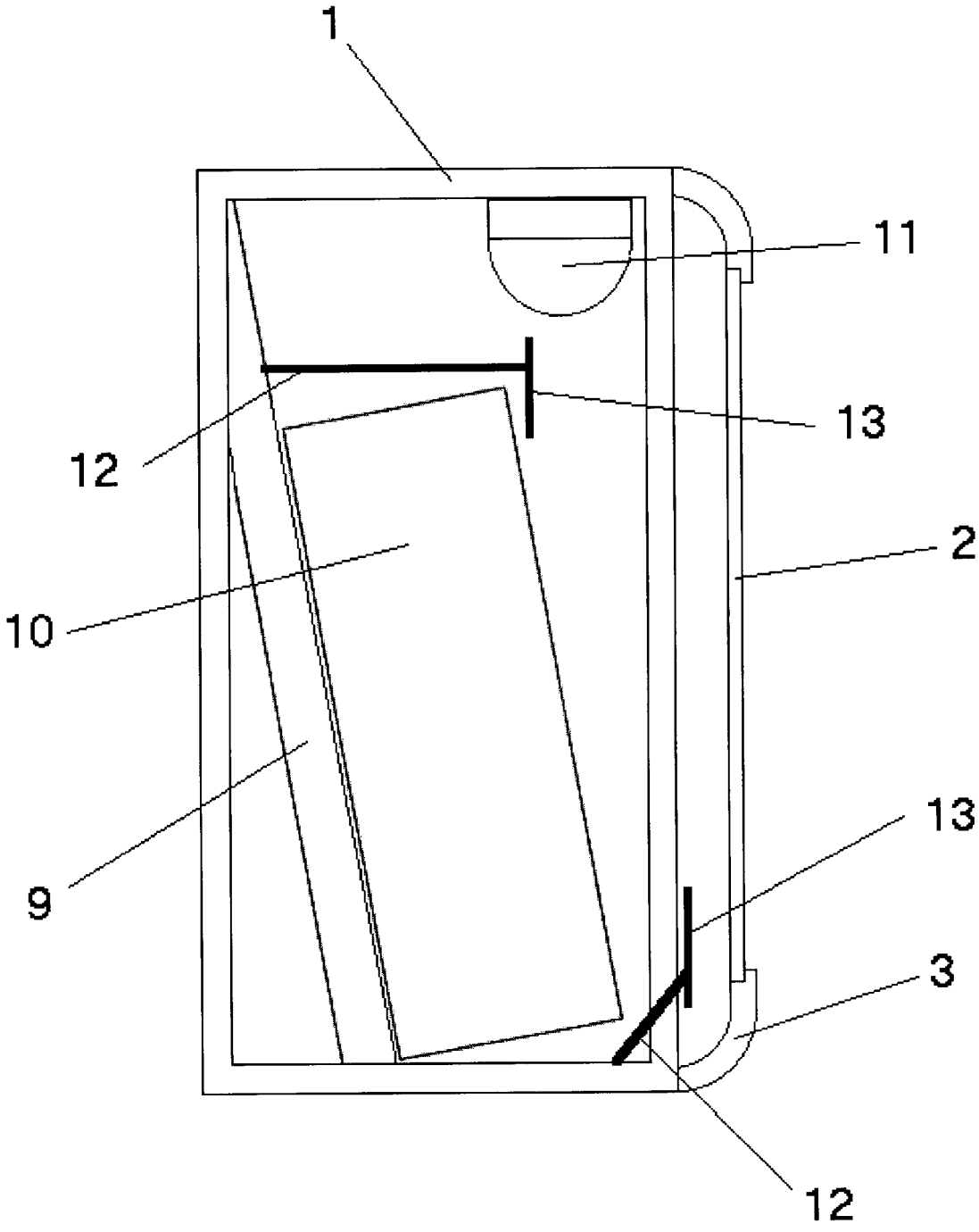
FIG. 2 is a cross-sectional side view of the invention of FIG. 1.

Referring now to FIG. 2, there is provided positioning means 9 for storing the contents of the container 1 is a substantially vertical position. For the purposes of this disclosure, "substantially vertical" means generally no more than 45 degrees from vertical, preferably no more than 30 degrees from vertical, more preferably no more than 15 degrees from vertical, and still more preferably no more than 10 degrees from vertical. FIG. 2 shows an open box or small container 10 containing the product resting 10 degrees from vertical back upon the positioning means 9 with the opening of the box facing a transparent surface 2. A preferred positioning means as shown comprises a series of strips or other perforated surface that permits the free flow of humid air within the container while providing adequate support. This is easily achieved by providing a plank of, for example, cedar wood cut in cross-section as shown in FIG. 2 and drilled through with multiple holes or perforations (not shown). Alternatively, strips of wood or other material may be cut in cross-section as shown an mounted at spaced intervals. The objective is to position the product so as to permit effective viewing through the transparent surfaces 2 and, further, to position the product so that it may be grasped laterally and removed horizontally from the container.

In a preferred embodiment, internal lighting 11 is also provided so as to effectively illuminate the product. Fluorescent lighting is preferred over incandescent lighting because the latter generates heat. Vapor-sealed lighting is preferred over non-sealed lighting in that the former is protected from the relatively high levels of humidity. Also preferred, when fluorescent lighting is used, are filters that screen out ultraviolet radiation that could otherwise damage organic products stored in the humidor. Such filters are commercially available from Environmental Lighting Systems, 485 Bergen Avenue, Ridgefield, N.J. 07657 and sold under the tradename "Spectrum Lighting Filters."

Figure 3:
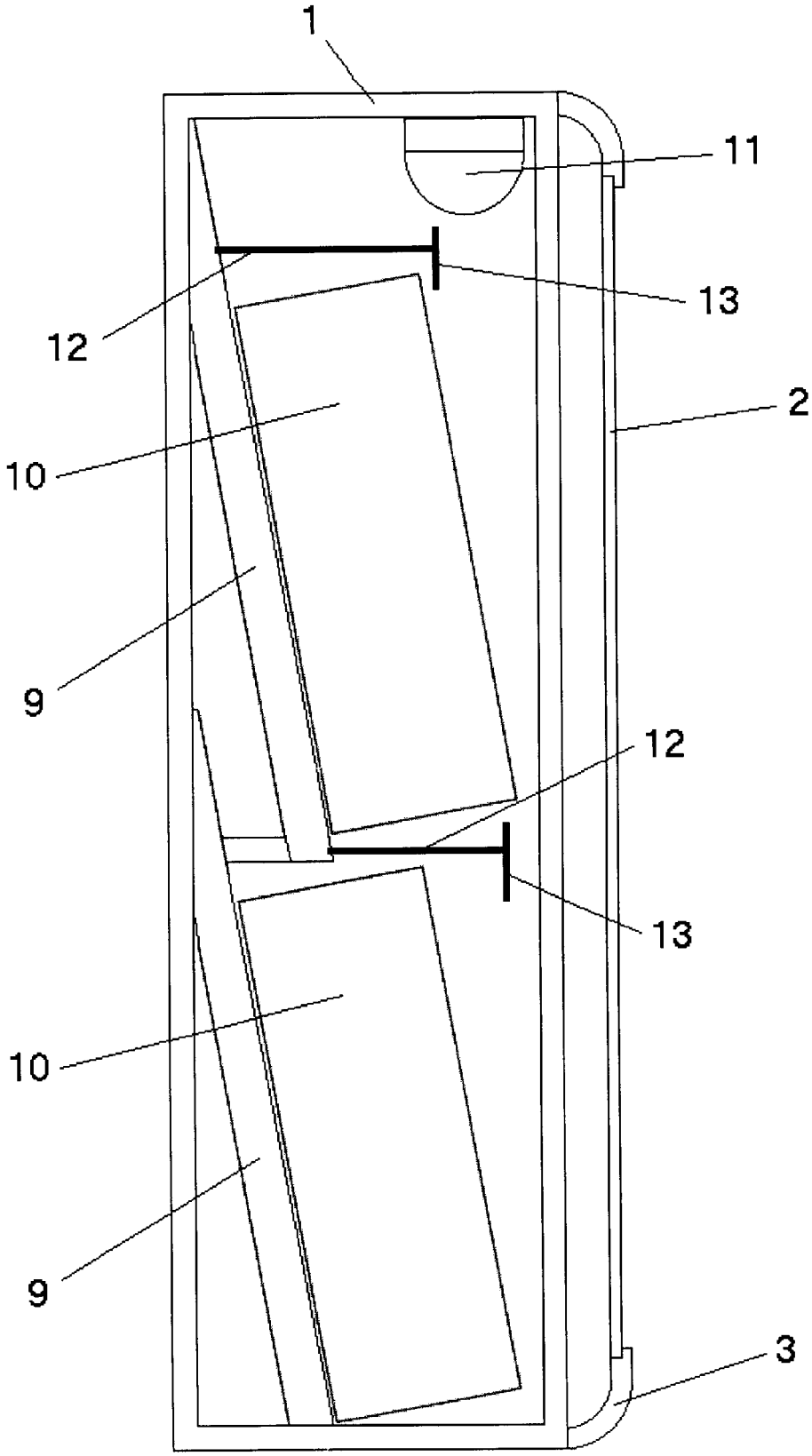
FIG. 3 is a cross-sectional side view of another embodiment of the invention.

Referring to FIG. 3, there is depicted another embodiment of the invention having a container 1 of elongated vertical dimension suitable for mounting upon a wall. Multiple tiers of support means 9 are provided. This embodiment is desirable for restaurant, tobacco shop, and other settings where floor space is at a premium. This particular embodiment may be constructed to comprise many tiers spread out over wide horizontal and high horizontal dimensions without intruding upon valuable floor space.

Because this embodiment is larger, it is preferred that the hatches be rabbeted to the container frame and/or have an elastic seal or o-ring to prevent humidity leakage, since the humidifier will need to replace a large volume of spilled air after each opening and closing. This will require a vent to be drilled into the container, preferably up through the bottom of the container. A preferred wall-mounted unit will not extend all the way to the floor (making floor space available for seated patrons), such that an accessible bottom surface will be available and exposed to air.

In this and all embodiments of elongated height, it is preferred that the humidifier be placed near the bottom of the container, so as to permit the humid air to rise upward.

Changes and modifications can be made by those skilled in the art to the embodiments as disclosed herein and such examples, illustrations, and theories are for explanatory purposes and are not intended to limit the scope of the claims.

What is claimed is:

1. A humidor comprising:

a container having a height, width, and depth;

means for controlling the humidity within said container;

said container having one or more transparent surfaces permitting viewing of the interior thereof;

said container having means for lateral access to the contents therein; and means for positioning a plurality of cigars in said container in a substantially vertical manner and position so as to permit effective viewing through said one or more transparent surfaces;

wherein the depth and height of said container is substantially smaller than said width.

2. The invention of claim 1 wherein:

said container is adapted to placement upon a barshelf.

3. The invention of claim 2 wherein said container is no more than 16 inches in height.

4. The invention of claim 1 wherein said container is no more than 16 inches in depth.

5. The invention of claim 1 wherein said container further comprises means for controlling the temperature therein.

6. The invention of claim 1 wherein said container further comprises a control panel section having controls accessible from outside said container for controlling the environment within said container.

7. The invention of claim 1 further comprising lights for illuminating the contents of said container.

8. The invention of claim 1 wherein said cigars are positioned and displayed so as to be tilted no more than 30 degrees from vertical.

9. The invention of claim 1 further comprising:

one or more small open containers placed within said container; and means for positioning said small open containers such that the openings thereof are in a substantially vertical position and effectively viewed through said transparent surfaces so as to permit viewing of the contents thereof.

10. The invention of claim 9 wherein said small open containers are adapted to holding tobacco products.

11. A humidor comprising:

a container having a height, width, and depth;

means for controlling the humidity within said container;

said container having one or more transparent surfaces permitting viewing of the interior thereof;

said container having means for lateral access to the contents therein;

wherein the depth of said container is substantially smaller than said width; and means for mounting said humidor upon a wall such that a bottom surface of said container is readily accessible to surrounding air.

12. The humidor of claim 11 wherein said bottom surface has one or more vents therethrough permitting air to enter said container.

13. The invention of claim 11 further comprising:

means for positioning a plurality of cigars, or boxes containing cigars, in said container in a substantially vertical manner and position so as to permit effective viewing through said one or more transparent surfaces.

14. The invention of claim 11 wherein said container further comprises means for controlling the temperature therein.

15. The Invention of claim 11 wherein said container further comprises a control panel section having controls accessible from outside said container for controlling the environment within said container.

16. The invention of claim 11 further comprising lights for illuminating the contents of said container.

17. The invention of claim 16 wherein said lighting is fluorescent and filtered through an ultraviolet screen lighting filter.

18. The invention of claim 7 wherein said lighting is fluorescent and filtered through an ultraviolet screen lighting filter.

* * * * *

UNITED STATES PATENT AND TRADEMARK OFFICE

CERTIFICATE OF CORRECTION

PATENT NO. : 6,308,437 B1
DATED : October 30, 2001
INVENTOR(S) : Villar

It is certified that error appears in the above-identified patent and that said Letters Patent is hereby corrected as shown below:

Title page,
The title page showing an illustrative figure, should be deleted and substitute therefor the attached title page.

Signed and Sealed this

Eighteenth Day of March, 2003

JAMES E. ROGAN
*Director of the United States Patent and Trademark Office*

(12) United States Patent
Villar

(10) Patent No.: US 6,308,437 B1
(45) Date of Patent: Oct. 30, 2001

(54) HUMIDOR WITH ENVIRONMENTAL CONTROL UNIT

(76) Inventor: Juan C. Villar, 36 Martin La., Westbury, NY (US) 11590

( * ) Notice: Subject to any disclaimer, the term of this patent is extended or adjusted under 35 U.S.C. 154(b) by 0 days.

(21) Appl. No.: 08/995,127

(22) Filed: Dec. 19, 1997

Related U.S. Application Data

(60) Provisional application No. 60/033,641, filed on Dec. 20, 1996.

(51) Int. Cl.[7] ..... F26B 21/06

(52) U.S. Cl. ..... 34/535; 34/542; 34/210; 34/219

(58) Field of Search ..... 34/380, 381, 389, 34/417, 535, 537, 542, 202, 210, 218, 219; 201/128, 130, 131, 142; 312/31.1; 131/250, 300, 328, 329; D27/183, 189, 190

(56) References Cited

U.S. PATENT DOCUMENTS

| | | | |
|---|---|---|---|
| D. 293,608 | 1/1988 | Fitzgerald | D27/45 |
| D. 380,582 | 7/1997 | Filias | D27/183 |
| D. 385,653 | 10/1997 | Wicker | D27/187 |
| D. 386,812 | 11/1997 | Schmidt | D27/187 |
| D. 389,601 | 1/1998 | Bartolotta | D27/188 |
| D. 389,952 | 1/1998 | Bartolotta | D27/188 |
| D. 391,670 | 3/1998 | Hargrove | D27/189 |
| D. 393,101 | 3/1998 | Kasuli | D27/187 |
| 4,008,930 | 2/1977 | Swainson | 312/31.1 |
| 4,428,892 * | 1/1984 | Berliner | 261/99 |
| 5,607,051 | 3/1997 | Espinosa | 206/213.1 |
| 5,651,262 | 7/1997 | Pendergast | 62/176.4 |
| 5,687,749 | 11/1997 | Brauer, Jr. | 131/329 |
| 5,741,444 | 4/1998 | Kasuli | 261/128 |
| 5,829,451 * | 11/1998 | Barber | 131/250 |

OTHER PUBLICATIONS

Heartland America catalog, p. 15, Item No. P3-4403, Apr. 1999.*

* cited by examiner

*Primary Examiner*—Henry Bennett
*Assistant Examiner*—Steve Gravini
(74) *Attorney, Agent, or Firm*—Cantor Colburn, LLP

(57) ABSTRACT

Disclosed is a humidor having means for controlling the humidity therein and having one or more transparent surfaces permitting viewing of the interior thereof. The humidor has means for lateral access to the contents therein and the depth of said container is substantially smaller than said width, thereby conserving space. Means are provided for displaying products, such as cigars, in a substantially vertical position for viewing through the transparent surfaces. In a preferred embodiment, the container is adapted to placement upon a shelf. In a preferred embodiment, an integrated environmental control unit that controls both temperature and humidity is described.

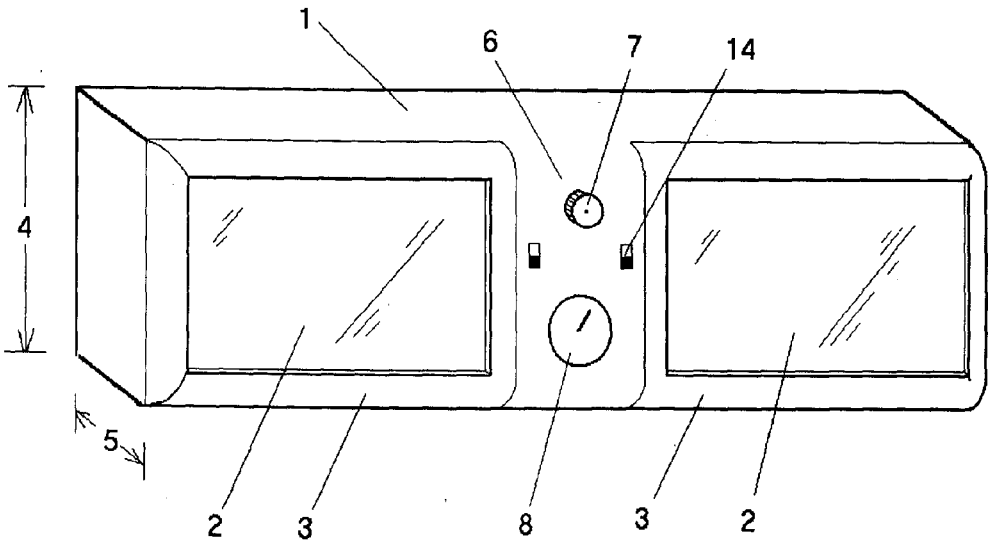

18 Claims, 4 Drawing Sheets